US008959710B2

(12) United States Patent
Wach et al.

(10) Patent No.: US 8,959,710 B2
(45) **Date of Patent: *Feb. 24, 2015**

(54) DOOR DAMPING MECHANISM

(75) Inventors: Ryan Robert Wach, Glendale, CA (US); John Michael Roche, Bishop, GA (US); Sesha Madireddi, St. Charles, MO (US); Raghujit Kunapuli, St. Charles, MO (US)

(73) Assignee: Anthony, Inc., Sylmar, CA (US)

( * ) Notice: Subject to any disclaimer, the term of this patent is extended or adjusted under 35 U.S.C. 154(b) by 51 days.

This patent is subject to a terminal disclaimer.

(21) Appl. No.: 13/315,155

(22) Filed: Dec. 8, 2011

(65) Prior Publication Data

US 2013/0145695 A1 Jun. 13, 2013

(51) Int. Cl.
*E05F 5/02* (2006.01)

(52) U.S. Cl.
USPC ..... 16/82; 16/49; 16/58; 16/85

(58) Field of Classification Search
USPC ..... 16/49, 54, 58, 66, 68, 50, 82, 84, 85, 16/72; 49/386; 188/322.5
See application file for complete search history.

(56) References Cited

U.S. PATENT DOCUMENTS

| | | | | | |
|---|---|---|---|---|---|
| 448,889 | A | * | 3/1891 | Seely | 16/84 |
| 2,940,111 | A | * | 6/1960 | Patriquin | 16/66 |
| 4,629,167 | A | * | 12/1986 | Kimura et al. | 267/226 |
| 4,707,882 | A | * | 11/1987 | Watts | 16/66 |
| 4,815,163 | A | | 3/1989 | Simmons | |
| 4,894,883 | A | * | 1/1990 | Fleischhauer | 16/66 |
| 4,948,103 | A | * | 8/1990 | Bowden et al. | 267/34 |
| 5,220,706 | A | * | 6/1993 | Bivens | 16/66 |
| 5,518,223 | A | * | 5/1996 | Bivens | 267/34 |
| 6,442,796 | B2 | * | 9/2002 | Arisaka et al. | 16/84 |
| 6,640,387 | B2 | * | 11/2003 | Alonso | 16/72 |
| 6,957,807 | B2 | * | 10/2005 | Zimmer et al. | 267/64.11 |
| 7,007,341 | B2 | | 3/2006 | Wang | |

OTHER PUBLICATIONS

International Search Report and Written Opinion issued on Mar. 15, 2013 in related PCT/US12/60644 application.

* cited by examiner

*Primary Examiner* — William Miller
(74) *Attorney, Agent, or Firm* — Jeffer Mangels Butler & Mitchell LLP; Brennan C. Swain, Esq.

(57) ABSTRACT

A damping device that includes an arm having a longitudinally extending slot and a cylinder cut-out defined therein, and a damping assembly secured in the cylinder cut-out. The damping assembly includes a cylinder housing with a chamber having a piston and fluid disposed therein. The piston includes a rod with a head on a distal end thereof that extends outside the cylinder housing and into the slot. The damping assembly includes a biasing member extending between the cylinder housing and the head.

19 Claims, 8 Drawing Sheets

DOOR DAMPING MECHANISM

FIELD OF THE INVENTION

The present invention relates generally to a door hold open mechanism with a damper, and more particularly, to a door hold open mechanism with a damper that is used with refrigerated display cases.

BACKGROUND OF THE INVENTION

Many refrigerator doors are equipped with torsional springs to ensure automatic closing of the refrigerator door to keep the cold air in the case. While the torsional spring closure mechanism provides a reliable mechanism to close the door, the impact of the door against the frame often over compresses the magnetic gasket, resulting in cracking of the flexible vinyl, which can shorten the life of the gasket and other portions of the door. Additionally, repeated impacts can shorten the life of various other related components of the door and frame, such as the corner joints of the door, light fixtures mounted to the frame, and other electrical equipment mounted in the door or frame, etc. Reducing the magnitude of this impact, while still providing reliable door closing, is desirable.

SUMMARY OF THE PREFERRED EMBODIMENTS

In accordance with a first aspect of the present invention there is provided a damping device that includes an arm having a longitudinally extending slot and a cylinder cut-out defined therein, and a damping assembly secured in the cylinder cut-out. The damping assembly includes a cylinder housing with a chamber having a piston and fluid disposed therein. The piston includes a rod with a head on a distal end thereof that extends outside the cylinder housing and into the slot. The damping assembly includes a biasing member extending between the cylinder housing and the head. In a preferred embodiment, the arm includes a curved bridge member that spans the slot and that includes a concave surface that defines a trough through which the piston rod extends. Preferably, the piston head includes a concave surface that is configured to contact a pin positioned in the slot. Preferably, the damping device includes a housing that includes separate upper and lower housing members that are secured to upper and lower surfaces of the arm and that each include a securing portion that engages the cylinder housing and at least one flange that is secured to the upper or lower surface of the arm. The securing portions of the upper and lower housing members preferably include a longitudinally extending opening defined therein.

In accordance with another aspect of the present invention there is provided a door assembly that includes a door frame, a door hingedly connected to the door frame, and a damping device extending between the door and the door frame. The damping device includes an art having first and second opposite ends and a longitudinally extending slot and a cylinder cut-out defined therein. The arm further includes an opening defined adjacent the first end and a first pin extending through the opening and into one of the door or the door frame and a second pin extending through the slot and into the other of the door or the door frame. The damping device further includes a damping assembly secured in the cylinder cut-out that includes a cylinder housing with a chamber having a piston and fluid disposed therein. The piston includes a rod with ahead on a distal end thereof that extends outside the cylinder housing and into the slot. The damping assembly includes a biasing member extending between the cylinder housing and the head.

In accordance with yet another aspect of the present invention there is provided a damping device that includes an arm that includes a longitudinally extending slot and a cylinder cut-out defined therein, a damping assembly and a housing that secures the damping assembly in the cylinder cut-out. The arm further includes a bridge member that spans the slot and that includes a concave surface that defines a touch. The damping assembly includes a cylinder housing with a chamber having a piston and fluid disposed therein. The piston includes a rod with a head on a distal end thereof that extends outside the cylinder housing and into the slot. The rod extends through the trough in the bridge member. The damping assembly includes a biasing member extending between the cylinder housing and the head, and the piston head includes a concave surface that is configured to contact a pin positioned in the slot. The housing includes separate upper and lower housing members that are secured to upper and lower surfaces of the arm, and that each include a securing portion that secures the damping assembly in place and at least one flange that is secured to the upper or lower surface of the arm. The securing portions of the upper and lower housing members include a longitudinally extending opening defined therein.

DETAILED DESCRIPTION OF THE PREFERRED EMBODIMENTS

Figure 1:
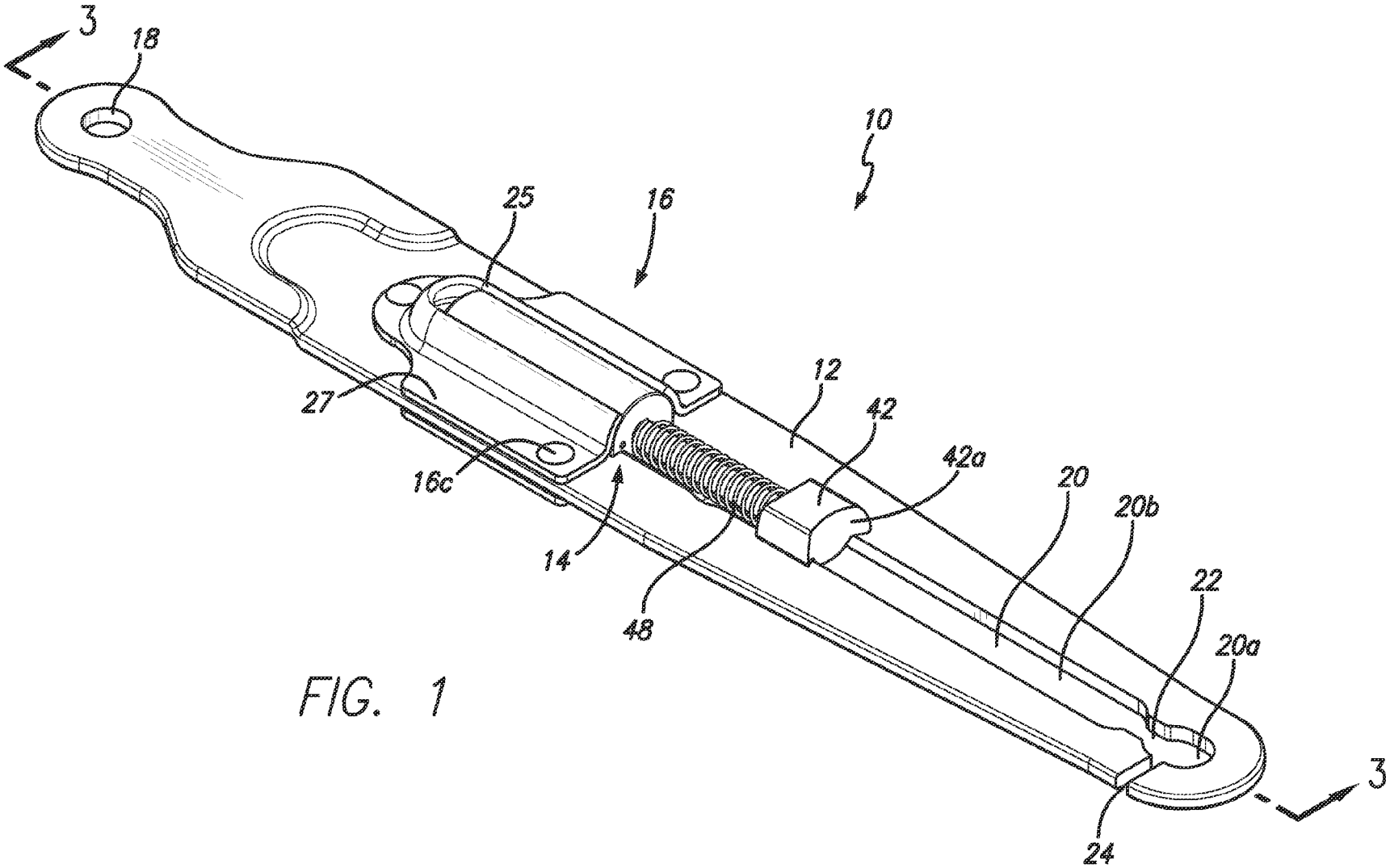
FIG. 1 is a perspective view of a door hold open mechanism with a damping device in accordance with a preferred embodiment of the present invention.

The following description and drawings are illustrative and are not to be construed as limiting. Numerous specific details are described to provide a thorough understanding of the disclosure. However, in certain instances, well-known or conventional details are not described in order to avoid obscuring the description. References to one or an embodiment in the present disclosure can be, but not necessarily are references to the same embodiment; and, such references mean at least one of the embodiments.

Reference in this specification to "one embodiment" or "an embodiment" means that a particular feature, structure, or characteristic described in connection with the embodiment is included in at least one embodiment of the disclosure. The appearances of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not other embodiments.

The terms used in this specification generally have their ordinary meanings in the art, within the context of the disclosure, and in the specific context where each term is used. Certain terms that are used to describe the disclosure are discussed below, or elsewhere in the specification, to provide additional guidance to the practitioner regarding the description of the disclosure. For convenience, certain terms may be highlighted, for example using italics and/or quotation marks: The use of highlighting has no influence on the scope and meaning of a term; the scope and meaning of a term is the same, in the same context, whether or not it is highlighted. It will be appreciated that the same thing can be said in more than one way.

Consequently, alternative language and synonyms may be used for any one or more of the terms discussed herein. Nor is any special significance to be placed upon whether or onto term is elaborated or discussed herein. Synonyms for certain terms are provided. A recital of one or more synonyms does not exclude the use of other synonyms. The use of examples anywhere in this specification including examples of any terms discussed herein is illustrative only, and is not intended to further limit the scope and meaning of the disclosure or of any exemplified term. Likewise, the disclosure is not limited to various embodiments given in this specification.

Without intent to further limit the scope of the disclosure, examples of instruments, apparatus, methods and their related results according to the embodiments of the present disclosure are given below. Note that titles or subtitles may be used in the examples for convenience of a reader, which in no way should limit the scope of the disclosure. Unless otherwise defined, all technical and scientific terms used herein have the same meaning as commonly understood by one of ordinary skill in the art to which this disclosure pertains. In the case of conflict, the present document, including definitions, will control.

It will be appreciated that terms such as "front," "back," "top," "bottom," "side," "short," "long," "up," "down," and "below" used herein are merely for ease of description and refer to the orientation of the components as shown in the figures. It should be understood that any orientation of the components described herein is within the scope of the present invention.

Referring now to the drawings, which are for purposes of illustrating the present invention and not for purposes of limiting the same, FIGS. 1-7 generally show a damping device 10. As is show in FIG. 6, in a preferred embodiment, the damping device 10 is mounted between the frame 100 and door 102 of a display case 104. See U.S. Pat. No. 3,980,331 to Kennedy (the "'331 patent"), the entirety of which is hereby incorporated by reference herein, which teaches a door check and hold open device. In the preferred embodiment, the damping device 10 includes a door hold-open feature. However, this is not a limitation on the present invention.

Figure 2:
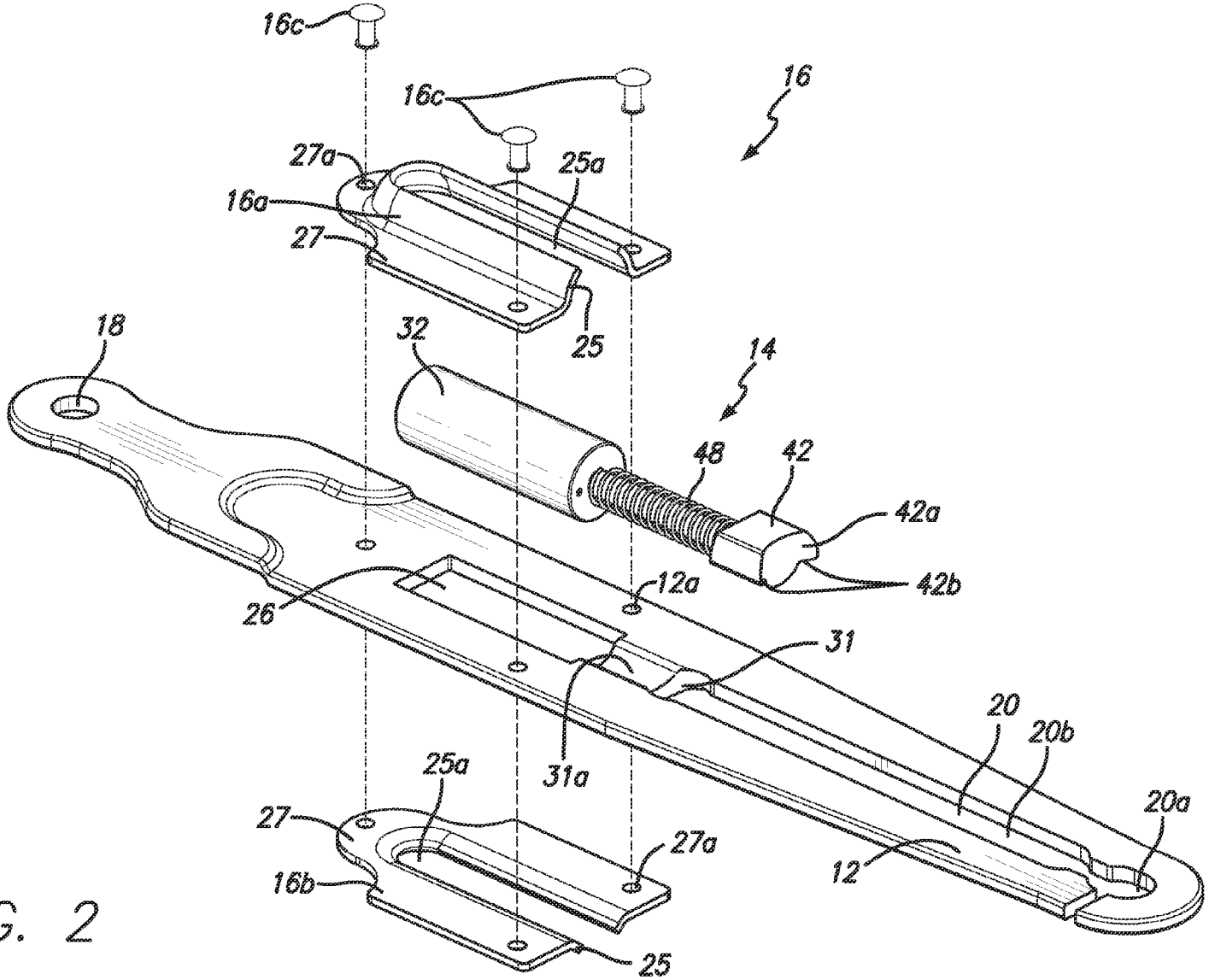
FIG. 2 is an exploded perspective view of the hold open mechanism of FIG. 1.

As shown in FIG. 2, device 10 includes a door check arm or main body portion 12, damping assembly 14 and housing 16. The door check am. 12 preferably comprises an elongated metal bar that is preferably formed of spring steel, having a hole 18 provided at one end thereof, and having an elongated slot 20 disposed along the longitudinal axis of the arm 12 and extending from near the center the arm 12 to an outer end thereof. A restriction 22 is provided in the slot 20 adjacent its outer end as shown in FIG. 2 and divides the slot 20 into first and second portions 20*a* and 20*b*. A slit 24 extends from the slot 20 to a side outer edge of the arm 12 to accentuate the spring ac (of the arm 12. Arm 12 also includes a cylinder cut-out 26 for receiving the damping assembly 14.

Figure 8:
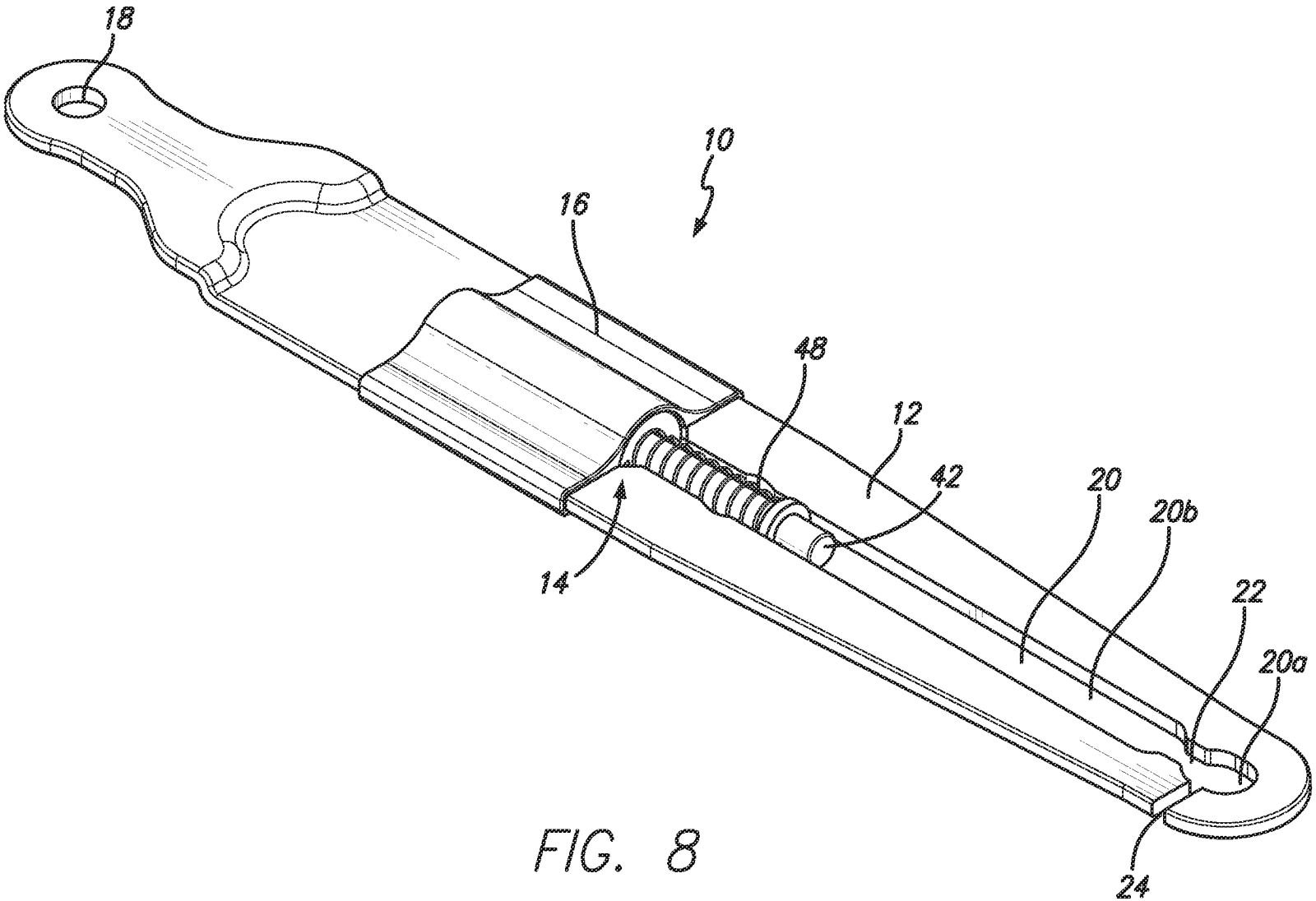
FIG. 8 is a perspective view of a door hold open mechanism with a damping device in accordance with another preferred embodiment of the present invention.

In a preferred embodiment, housing 16 includes an upper housing portion 16*a* and a lower housing portion 16*b* and is sized to fit over arm 12 and damping assembly 14 and to retain the cylinder portion of the damping assembly in cut-out 26. As shown in FIGS. 1-2, in a preferred embodiment, housing 16 is held in place by rivets 16*c*, which also extend through openings 12*a* in arm 12. In a preferred embodiment, the upper and lower housing portions or cover plates 16*a* and 16*b* include a securing portion 25 and at least one flange 27 extending outwardly therefrom. The securing portion 25 secures the damping assembly 14 in place and the flange 27 includes openings 27*a* for receiving the rivets 16*c*. Preferably, the securing portions 25 of the upper and lower housing portions 16*a* and lob include longitudinally extending openings 25*a* therein. There is only a limited amount of clearance available between the door 102 and frame 100 in a conventional display case 104. The longitudinally extending openings 25*a* help maximize the size of damping assembly 14, while minimizing clearance. In another embodiment, housing 16 can be welded in place or threaded fasteners can be used. As shown in FIG. 8, in another embodiment, housing 16 can be unitary. Any method of securing the damping assembly 14 in place is within the scope of the present invention.

To secure damping device 10 on display case 104, a pivot pin 28 is received in the hole 18 in arm 12 and passes therethrough to engage an aligned opening provided in the frame 100, and a multi-stepped pin or threaded fastener 30 is also associated with the arm 12 and is received in the slot 20 and an aligned opening (not shown) in the door 102. The operation of the hold-open portion of the device is described in the '331 patent.

In a preferred embodiment, the arm 12 includes a bridge member 31 that spans slot 20. The bridge member 31 adds stiffness to the arm 12 and helps maintain the door 102 in the open position when the pin 30 is captured in the detent/first portion 20*a* of slot 20 (as described below). The bridge member 31 also partially defines cut-out 26.

In use, generally, when the door closes from about the 90° open position, pin 30 comes out of the &tent position, and the fork/arm 12 (as a result of slot 20) moves along pin 30. When the door 102 is between about 1° and about 30° from closing, the piston head 42 contacts pin 30, thereby providing a smooth fluid damping of the door rotation, allowing it to gently close, which is more fully described below.

Figure 3:
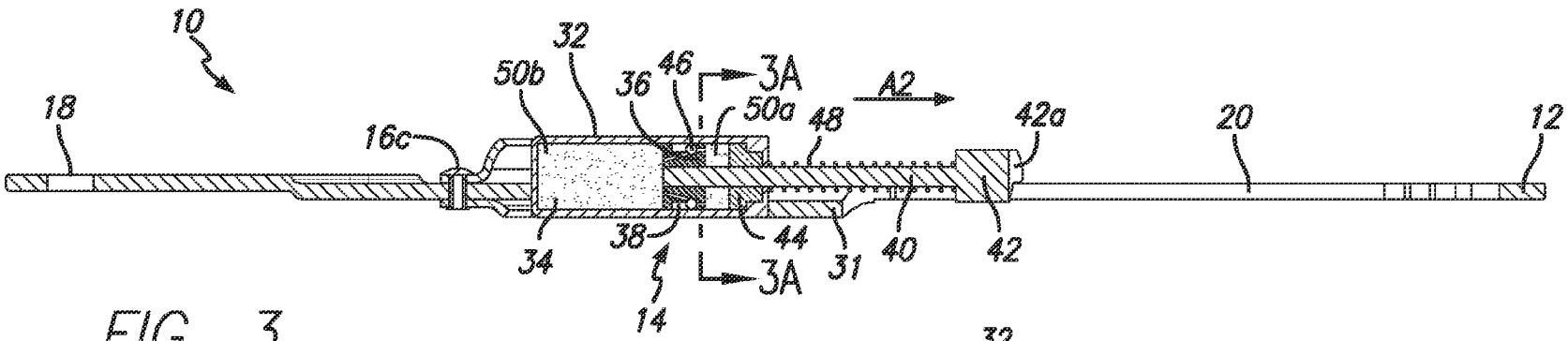
FIG. 3 is a longitudinal cross-sectional view of the hold open mechanism of FIG. 1 taken along line 3-3 of FIG. 1.
Figure 3A:
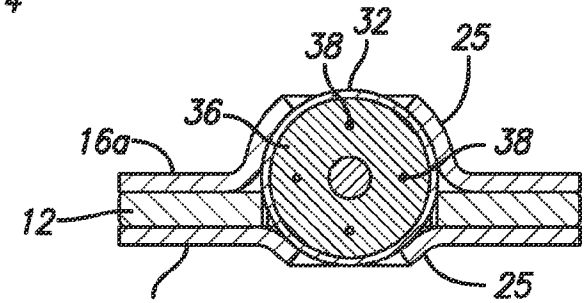
FIG. 3A is a transverse cross-sectional view of the hold open mechanism of FIG. 1 taken along line 3A-3A of FIG. 3.
Figure 4:
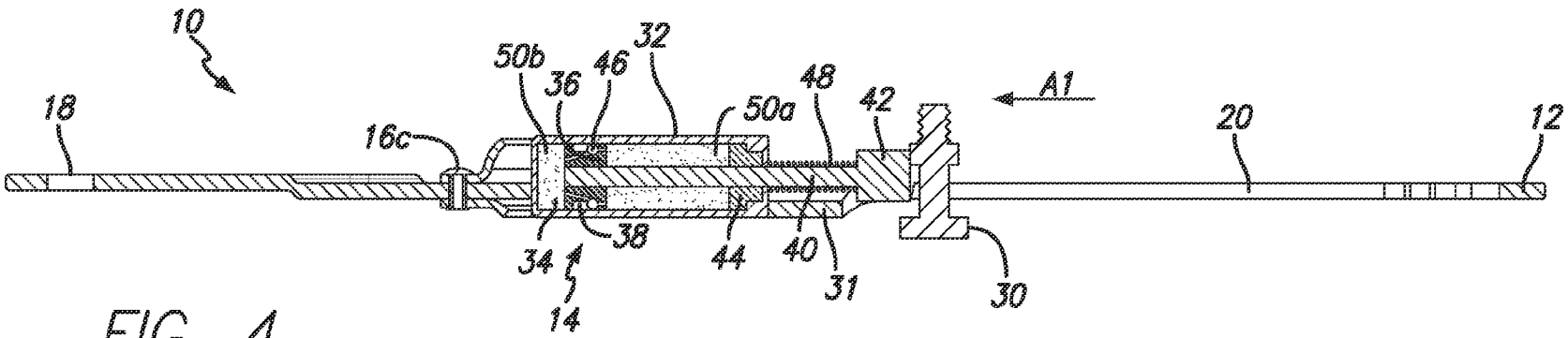
FIG. 4 is a cross-sectional view of the hold open mechanism of FIG. 1 showing the damping assembly in the damping position.
Figure 5:
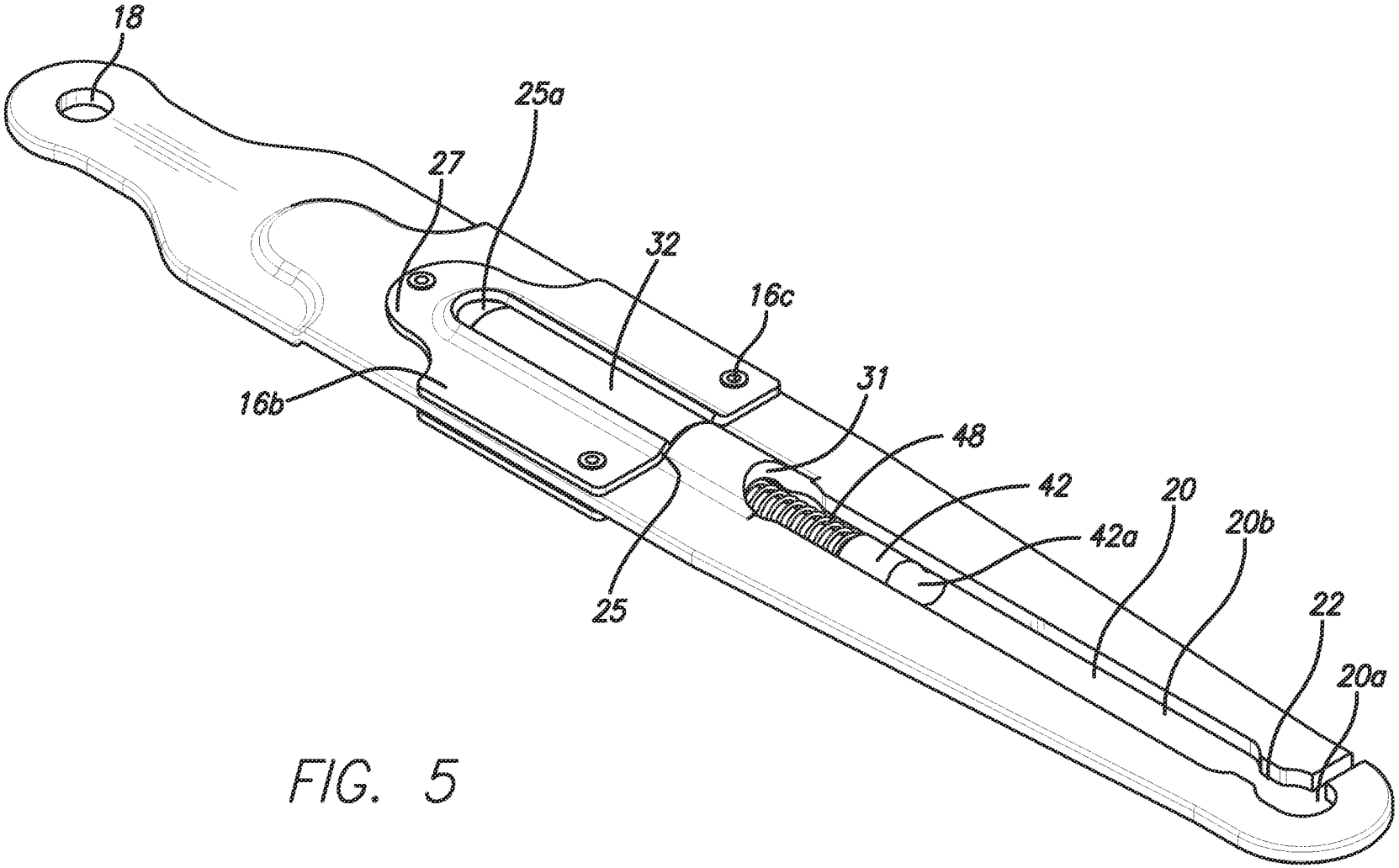
FIG. 5 is a bottom perspective view of the hold open mechanism of FIG. 1.
Figure 6:
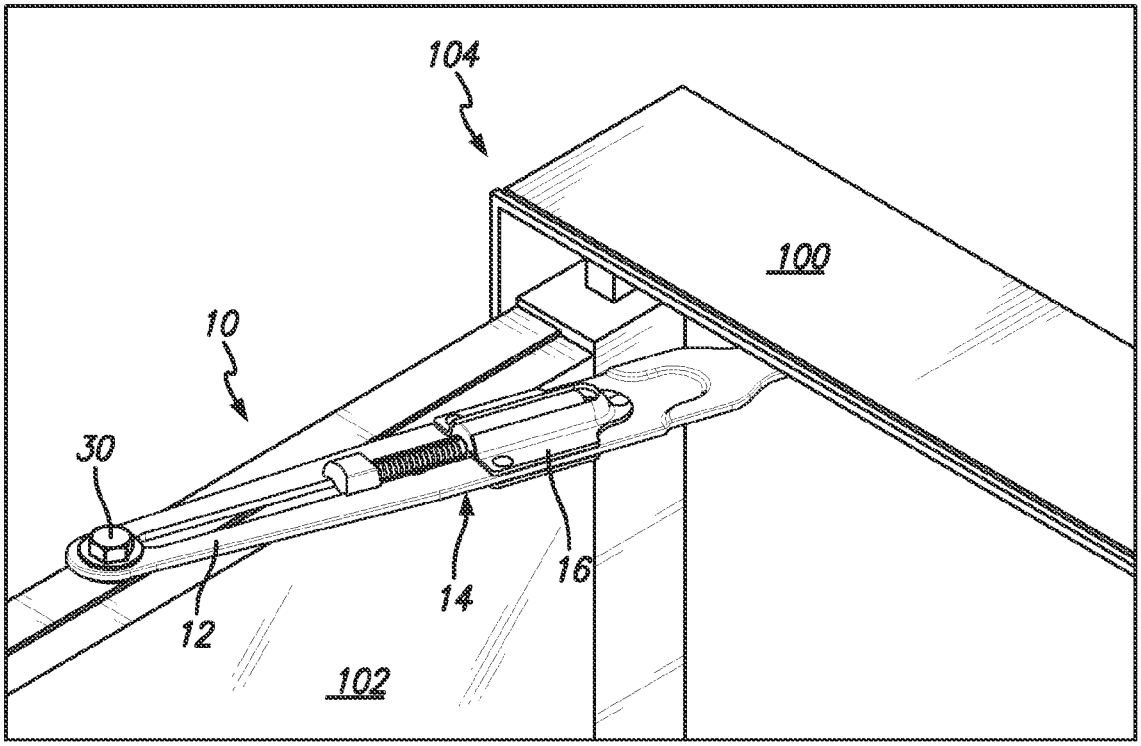
FIG. 6 is an outside perspective view of the hold open mechanism of FIG. 1 attached to the frame and door of a refrigerated display case and showing the door in the open position.
Figure 7:
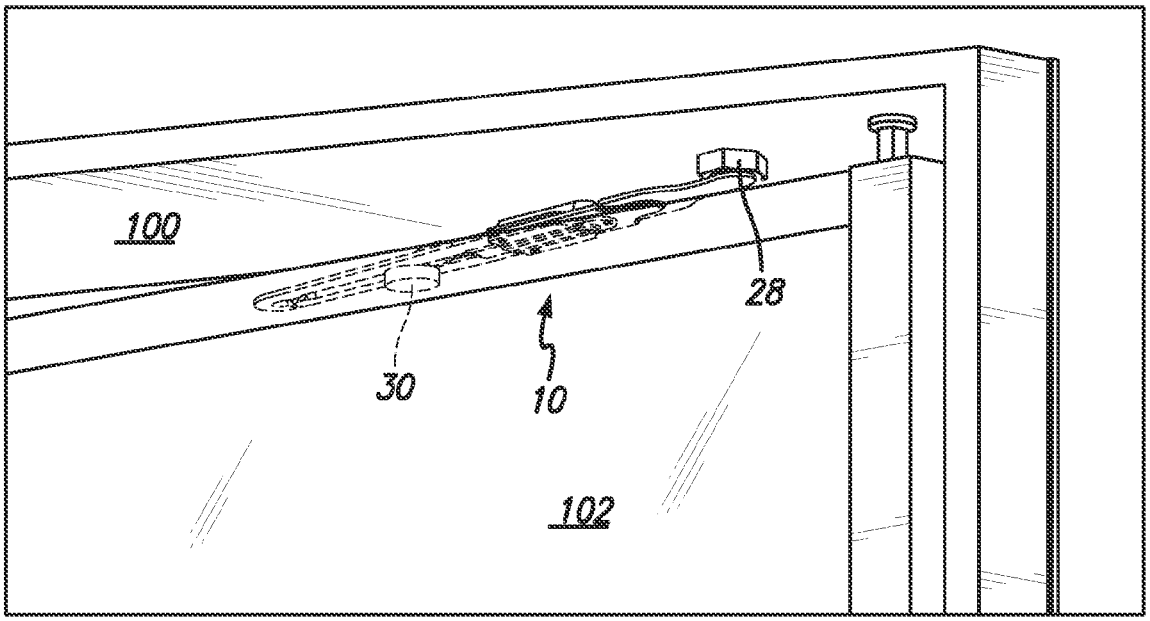
FIG. 7 is an inside perspective view of the hold open mechanism of FIG. 1 attached to the frame and door of a refrigerated display case and showing the door almost closed.

FIGS. 3 and 4 show the damping assembly in the non-damped and damped positions, respectively. FIGS. 3-4 show the interior of the damping assembly 14, which includes a cylinder housing 32 filled with damping fluid 34, a piston 36 with four orifices 38 defined therein, a rod 40 and piston head 42, a piston seal 44, o-ring 46, and return spring or biasing member 48 that extends between the cylinder housing 32 and the piston head 42. Piston 36 divides the interior of the cylinder into two chambers 50*a* and 50*b*. Piston rod 40 extends through seal 44 and outside cylinder housing 32. Preferably, the bridge member 31 is curved to provide space for piston rod 40. The bridge member 31 has a concave surface 31*a* that defines a trough through which the piston rod 40 extends. In use, when a force is applied on piston head 42 axially, the piston rod 40 (together with piston 36) moves in the direction of arrow A1 (see FIG. 4) compressing the helical spring 48. The moving piston 36 forces the damping fluid 34 to flow through two of the four orifices 38, thereby restricting the flow. Metering the fluid 34 flow through two orifices 38 from one chamber 50*a* to the other chamber 50*b* produces the damping effect (i.e. slow closure of the door). When the door is opened, and the external force is removed from the piston head 42, the piston rod 40 returns to its original position (in the direction of arrow A2 in FIG. 3) allowing the damping fluid 34 to flow through four orifices from one chamber 50*b* to the other chamber 50*a*. There is little to no restriction on the fluid 38 flow in this direction. Also, the compressed coil helical spring 48 returns to its original position thus retracting the piston rod 40 and piston 36.

In a preferred embodiment, the fluid 34 is silicon oil, however, this is not a limitation on the present invention. Furthermore, any number of orifices is within the scope of the present invention. As will be appreciated by those skilled in the art, the damping assembly 14 is characterized by its damping constant, which depends upon the piston geometry, orifice diameter, number of orifices, dynamic viscosity of the fluid and the helical spring constant.

In a preferred embodiment, the piston head 42 includes a concave surface 42*a* for conformal contact with pin 30, and includes cut outs 42*b* that conform to the surface of arm 12 and slot 20, as shown in FIG. 1.

FIG. 8 shows an embodiment of the damping device 10 where the curved bridge member has been omitted, the housing 16 is unitary and the piston head 42 is not curved.

Figure 9:
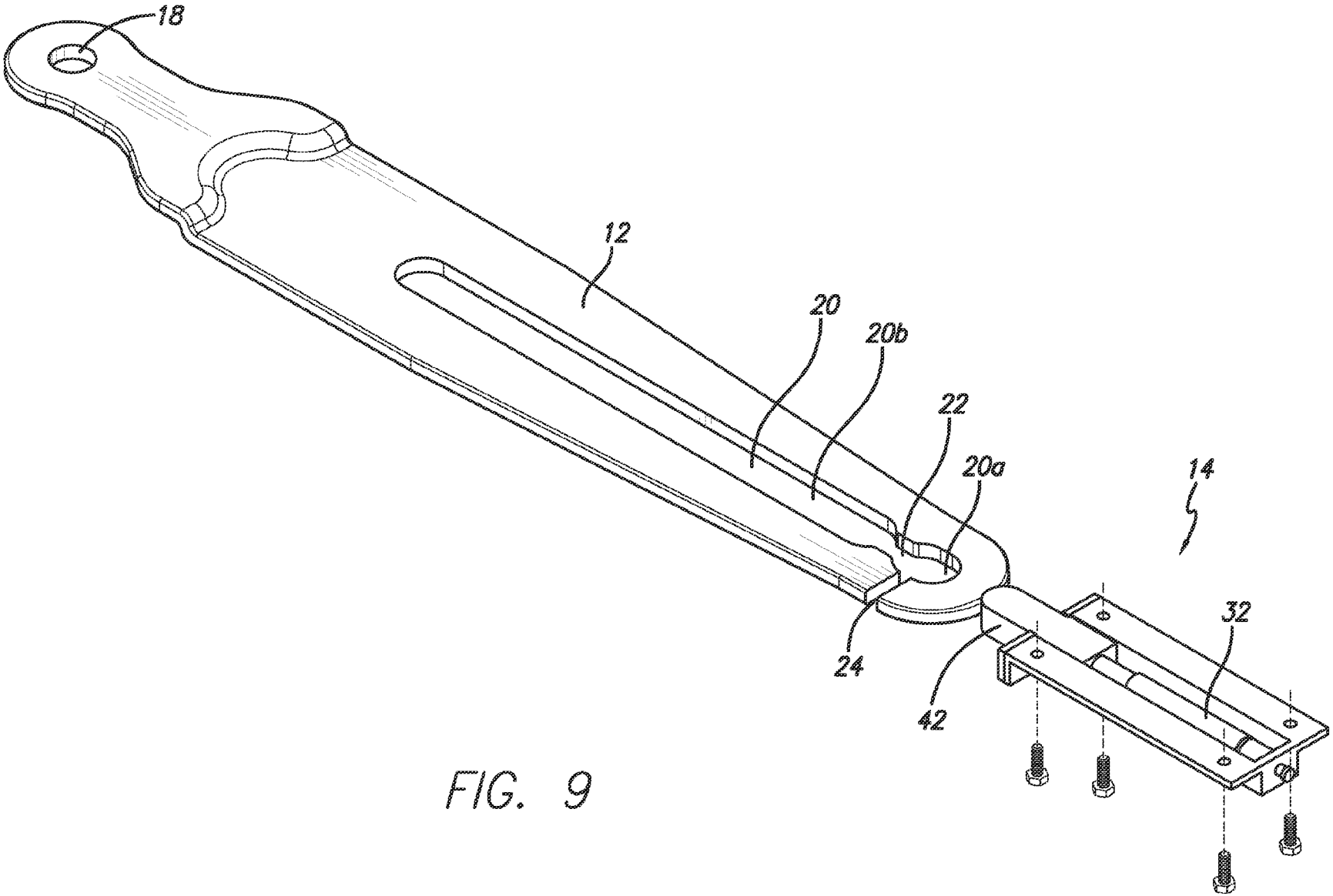
FIG. 9 is a perspective view of a door hold open mechanism with a damping device in accordance with yet another preferred embodiment of the present invention.

FIG. 9 shows an alternative embodiment, where a damping member 114 is designed to be secured via threaded fasteners or the like to the underside of the frame of the display case. In this embodiment, the end of the arm 12 contacts the end of the piston rod 40 as the door closes, thereby damping the closing of the door.

In another embodiment, the damping device 10 described above can include a screw thread adjustment (not shown) to move the static position of the damping assembly 14 linearly, thus allowing for adjustment of the damping engagement point, and allowing the user to choose damping from any desired angle, e.g., from about 45° down to about 5° from closure. In this embodiment, the cut-out 26 can be sized so that the damping assembly can move linearly or axially along arm 12 via a threaded adjustment member. The adjustability moves the piston head 42 within slot 20 and toward or away from the first portion 20*a* of the slot, thus lengthening or shortening the distance that pin 30 moves before coming into contact with piston head 42.

Unless the context clearly requires otherwise, throughout the description and the claims, the words "comprise," "comprising," and the like are to be construed in an inclusive sense, as opposed to an exclusive or exhaustive sense; that is to say, in the sense of "including, but not limited to." As used herein, the terms "connected," "coupled," or any variant thereof, means any connection or coupling, either direct or indirect, between two or more elements; the coupling of connection between the elements can be physical, logical, or a combination thereof. Additionally, the words "herein," "above," "below," and words of similar import, when used in this application, shall refer to this application as a whole and not to any particular portions of this application. Where the context permits, words in the above Detailed Description of the Preferred Embodiments using the singular or plural number may also include the plural or singular number respectively. The word "or" in reference to a list of two or more items, covers all of the following interpretations of the word: any of the items in the list, all of the items in the list, and any combination of the items in the list.

The above-detailed description of embodiments of the disclosure is not intended to be exhaustive or to limit the teachings to the precise form disclosed above. While specific embodiments of and examples for the disclosure are described above for illustrative purposes, various equivalent modifications are possible within the scope of the disclosure, as those skilled in the relevant art will recognize. For example, while processes or blocks are presented in a given order, alternative embodiments may perform routines having steps, or employ systems having blocks, in a different order, and some processes or blocks may be deleted, moved, added, subdivided, combined, and/or modified to provide alternative or subcombinations. Each of these processes or blocks may be implemented in a variety of different ways. Also, while processes or blocks are at times shown as being performed in series, these processes or blocks may instead be performed in parallel, or may be performed, at different times. Further any specific numbers noted herein are only examples: alternative implementations may employ differing values or ranges.

The teachings of the disclosure provided herein can be applied to other systems, not necessarily the system described above. The elements and acts of the various embodiments described above can be combined to provide further embodiments.

Any patents and applications and other references noted above, including any that may be listed in accompanying filing papers, are incorporated herein by reference in their entirety. Aspects of the disclosure can be modified, if necessary, to employ the systems, functions, and concepts of the various references described above to provide yet further embodiments of the disclosure.

These and other changes can be made to the disclosure in light of the above Detailed Description of the Preferred Embodiments. While the above description describes certain embodiments of the disclosure, and describes the best mode contemplated, no matter how detailed the above appears in text, the teachings can be practiced in many ways. Details of the system may vary considerably in its implementation details, while still being encompassed by the subject matter disclosed herein. As noted above, particular terminology used when describing certain features or aspects of the disclosure should not be taken to imply that the terminology is being redefined herein to be restricted to any specific characteristics, features or aspects of the disclosure with which that terminology is associated. In general, the terms used in the following claims should not be construed to limit the disclosures to the specific embodiments disclosed in the specification unless the above Detailed Description of the Preferred Embodiments section explicitly defines such terms. Accordingly, the actual scope of the disclosure encompasses not only the disclosed embodiments, but also all equivalent ways of practicing or implementing the disclosure under the claims.

While certain aspects of the disclosure are presented below in certain claim forms, the inventors contemplate the various aspects of the disclosure in any number of claim forms. For example, while only one aspect of the disclosure is recited as a means-plus-function claim under 35 U.S.C. §112, ¶6, other aspects may likewise be embodied as a means-plus-function claim, or in other forms, such as being embodied in a computer-readable medium. (Any claims intended to be treated under 35 U.S.C. §112, ¶6 will begin with the words "means for"). Accordingly, the applicant reserves the right to add additional claims after filing the application to pursue such additional claim forms for other aspects of the disclosure.

Accordingly, although exemplary embodiments of the invention have been shown and described, it is to be understood that all the terms used herein are descriptive rather than limiting, and that many changes, modifications, and substitutions may be made by one having ordinary skill in the art without departing from the spirit and scope of the invention.

What is claimed is:

1. A damping device comprising:

an arm having first and second opposite ends, wherein the arm includes a longitudinally extending slot and a cylinder cut-out that are both defined therein at a position between the first and second opposite ends, and a damping assembly secured in the cylinder cut-out, wherein the damping assembly includes a cylinder housing with a chamber having a piston and fluid disposed therein, wherein the piston includes a rod with a head on a distal end thereof that extends outside the cylinder housing and into the slot at a position between the first and second opposite ends, wherein the damping assembly includes a biasing member extending between the cylinder housing and the head.

2. The damping device of claim 1 wherein the damping assembly is secured in the cylinder cut-out by a housing that at least partially surrounds the cylinder housing and a portion of the arm.

3. The damping device of claim 2 wherein the housing includes separate upper and lower housing members that are secured to upper and lower surfaces of the arm, respectively.

4. The damping device of claim 3 wherein the upper and lower housing members each include a securing portion that engages the cylinder housing and at least one flange that is secured to the upper or lower surface of the arm.

5. The damping device of claim 4 wherein the securing portions of the upper and lower housing members include a longitudinally extending opening defined therein.

6. The damping device of claim 1 wherein the arm includes a slot narrowing restriction that divides the slot into first and second portions.

7. A damping device comprising:

an arm that includes a longitudinally extending slot and a cylinder cut-out defined therein, and a damping assembly secured in the cylinder cut-out, wherein the damping assembly includes a cylinder housing with a chamber having a piston and fluid disposed therein, wherein the piston includes a rod with a head on a distal end thereof that extends outside the cylinder housing and into the slot, wherein the damping assembly includes a biasing member extending between the cylinder housing and the head, wherein the arm includes a bridge member that spans the width of the slot.

8. The damping device of claim 7 wherein the bridge member is curved and includes a concave surface that defines a trough through which the piston rod extends.

9. A damping device comprising:

an arm that includes a longitudinally extending slot and a cylinder cut-out defined therein, and a damping assembly secured in the cylinder cut-out, wherein the damping assembly includes a cylinder housing with a chamber having a piston and fluid disposed therein, wherein the piston includes a rod with a head on a distal end thereof that extends outside the cylinder housing and into the slot, wherein the damping assembly includes a biasing member extending between the cylinder housing and the head, wherein the piston head includes a concave surface that is configured to contact a pin positioned in the slot.

10. A door assembly comprising:

a door frame, a door hingedly connected to the door frame, and a damping device extending between the door and the door frame, the damping device comprising:

an arm having first and second opposite ends and including a longitudinally extending slot and a cylinder cut-out that are both defined therein at a position between the first and second opposite ends, wherein the arm further includes an opening defined adjacent the first end, wherein the arm includes a first pin extending through the opening and into one of the door or the door frame and a second pin extending through the slot and into the other of the door or the door frame, and a damping assembly secured in the cylinder cut-out, wherein the damping assembly includes a cylinder housing with a chamber having a piston and fluid disposed therein, wherein the piston includes a rod with a head on a distal end thereof that extends outside the cylinder housing and into the slot at a position between the first and second opposite ends, wherein the damping assembly includes a biasing member extending between the cylinder housing and the head.

11. The door assembly of claim 10 wherein the arm includes a bridge member that spans the width of the slot.

12. The door assembly of claim 11 wherein the bridge member is curved and includes a concave surface that defines a trough through which the piston rod extends.

13. The door assembly of claim 10 wherein the piston head includes a concave surface that is configured to contact the second pin when the door is closed.

14. The door assembly of claim 10 wherein the damping assembly is secured in the cylinder cut-out by a housing that at least partially surrounds the cylinder housing and a portion of the arm.

15. The door assembly of claim 14 wherein the housing includes separate upper and lower housing members that are secured to upper and lower surfaces of the arm, respectively.

16. The door assembly of claim 15 wherein the upper and lower housing members each include a securing portion that engages the cylinder housing and at least one flange that is secured to the upper or lower surface of the arm.

17. The door assembly of claim 16 wherein the securing portions of the upper and lower housing members include a longitudinally extending opening defined therein.

18. The door assembly of claim 10 wherein the arm includes a slot narrowing restriction that divides the slot into first and second portions, and a slit that extends from the slot to an outer surface of the arm.

19. A damping device comprising:

an arm that includes a longitudinally extending slot and a cylinder cut-out defined therein, wherein the arm further includes a bridge member that spans the width of the slot, wherein the bridge member is curved and includes a concave surface that defines a trough, a damping assembly positioned in the cylinder cut-out, wherein the damping assembly includes a cylinder housing with a chamber having a piston and fluid disposed therein, wherein the piston includes a rod with a head on a distal end thereof that extends outside the cylinder housing and into the slot, wherein the rod extends through the trough in the bridge member, wherein the damping assembly includes a biasing member extending between the cylinder housing and the head, wherein the piston head includes a concave surface that is configured to contact a pin positioned in the slot, and a housing that includes separate upper and lower housing members that are secured to upper and lower surfaces of the arm, respectively, wherein the upper and lower housing members each include a securing portion that that secures the damping assembly in the cut-out and at least one flange that is secured to the upper or lower surface of the arm, wherein the securing portions of the upper and lower housing members include a longitudinally extending opening defined therein.

* * * * *